United States Patent [19]

Huon de Kermadec

[11] Patent Number: 4,766,696

[45] Date of Patent: Aug. 30, 1988

[54] AUTOMATIC SLIDING DOOR OPERATING DEVICE FOR GUIDED VEHICLE

[75] Inventor: Jean Huon de Kermadec, Le Chesnay, France

[73] Assignee: SOULE, Bagneres de Bigorre, France

[21] Appl. No.: 929,377

[22] Filed: Nov. 12, 1986

[30] Foreign Application Priority Data

Nov. 13, 1985 [FR] France ..... 85 16728

[51] Int. Cl.[4] ..... E05F 13/02

[52] U.S. Cl. ..... 49/262; 104/20; 105/341

[58] Field of Search ..... 49/262; 105/341; 104/18, 20; 198/321, 324

[56] References Cited

U.S. PATENT DOCUMENTS

| | | | |
|---|---|---|---|
| 3,467,026 | 9/1969 | Broggie et al. | 105/341 |
| 3,759,566 | 9/1973 | Sobey et al. | 105/341 X |
| 3,971,324 | 7/1976 | Frech | 105/341 X |
| 4,152,870 | 5/1979 | Knap | 49/118 |
| 4,413,568 | 11/1983 | Huon de Kermadec | 104/20 |
| 4,503,778 | 3/1985 | Wilson | 49/262 X |
| 4,512,259 | 4/1985 | Huon de Kermadec | 104/208 |

FOREIGN PATENT DOCUMENTS

| | | |
|---|---|---|
| 2733295 | 1/1978 | Fed. Rep. of Germany . |
| 507984 | 9/1920 | France . |
| 2414608 | 8/1979 | France . |

*Primary Examiner*—Philip C. Kannan

*Attorney, Agent, or Firm*—Perry Carvellas

[57] ABSTRACT

A tracked transportation system uses an automatic car door opening and closing system. The car door or one panel of a two-panel door carries a lever on which is a rear abutment member designed to roll along an outside surface at the bottom of the car. This member enters a housing when the door is closed. The door is closed by holding it as the car moves slowly along a platform, by means of a hook attached to the lever.

32 Claims, 3 Drawing Sheets

AUTOMATIC SLIDING DOOR OPERATING DEVICE FOR GUIDED VEHICLE

BACKGROUND OF THE INVENTION

1. Field of the Invention

The invention concerns a transportation system employing at least one car moving on a guide track, a railroad type track, for example; the invention is more particularly concerned with system for automatically closing and opening the door or doors of the car while the car is moving slowly in a station.

2. Description of the Prior Art

U.S. Pat. Nos. 4,413,568 and 4,512,259 describe a transportation system using cars designed to transport passengers over average distances in the order of a few hundred meters, each car being designed to accommodate a limited number of passengers, in the order of ten passengers, for example. In a system of this kind a cable is driven in a closed loop and continuously along the guide track and the car is or the cars are hooked onto it, outside a station, by appropriate gripping means in order to be driven from one point to another. The system comprises at least one embarkation and/or disembarkation station. Each car in a station is uncoupled from the cable and taken up by decelerator or accelerator belts which come into contact with braked wheels carried by the car. The cooperation of these braked wheels with a succession of such belts makes it possible to displace the cabin at predetermined speeds within the station and in particular along the disembarkation platform and the embarkation platform, where its speed is the lowest, to enable passengers to leave or enter the car while it is moving slowly.

A system of this kind functions in a satisfactory way but for it to be operable under semi-automatic conditions, and even without human supervision, certain provisions must be implemented to protect the safety of the passengers. To this end the car or each car is fitted with at least one door and it is necessary to provide means for operating the door in a predetermined sequence while the car is moving in a station and for locking the door in between stations.

The invention proposes to provide a solution to all these requirements. The basic idea behind the invention consists in exploiting the fact that the car continues to move slowly during the embarkation and disembarkation phases in order to operate the doors, at least in part by means of the movement of the car itself, and to condition the operating sequences of at least some of the door operating and locking mechanisms to such slow displacement.

SUMMARY OF THE INVENTION

The invention consists in a transportation system employing at least one car provided with at least one sliding door, comprising means for locking said at least one door in a closed position, means for unlocking said at least one door adapted to be operated as said car passes a predetermined location, and means for securing said at least one door until said locking means are operated when said car reaches a location at which said at least one door is required to be closed.

The combination of these means therefore procures the required conditions for safety and automation, that is to say at least the automatic closing of the door on leaving a station, exploiting the slow movement of the car along the platform, together with locking of the door in the closed position except during the embarkation and disembarkation movements.

In a preferred embodiment the locking means comprise a lever pivoted to the at least one door, a rear abutment member on the lever adapted to come into contact with a surface of the car, spring means urging the lever into contact with the surface via the rear abutment means, and a housing in the surface adapted to receive the rear abutment means when the at least one door is closed, and wherein the unlocking means comprise means for turning the lever against the action of the spring means in the direction tending to disengage the rear abutment member from the housing when the car reaches a location at which the at least one door is required to be unlocked.

The invention applies to a door with one or two panels movable in their own plane, as indicated hereinabove. In the case of a two-panelled door, the panels are advantageously coupled together by an arrangement of cables, chains or the like so that the two panels move symmetrically and at the same speed relative to the door opening in the car.

The door retaining means preferably comprise a first hook fastened to the lever and adapted to project laterally when the rear abutment member is in contact with the surface, in which position it is adapted to cooperate with retaining means disposed at a location where the at lest one door is required to be closed, and to occupy a retracted position when the rear abutment member is in the housing.

In another embodiment, the door securing means comprise friction engagement means and means adapted to urge the friction engagement means against the outside surface of the at least one door; thus the door is closed as the car moves. Similarly, the door may be opened by an analogous mechanism comprising an engagement roller adapted to be rotated at a speed such that the tangential speed at its surface is greater than the speed of the car as it passes the roller and spring means adapted to urge the roller towards the outside surface of the at least one door. Thus the door is opened at a linear speed equal to the difference between the tangential speed at the surface of the engagement roller and the speed at which the car is moving.

In the case of a door comprising two panels coupled to each other in the manner described hereinabove, the door may be opened by providing a second lever equipped with an analogous hook on the second panel of the door relative to the direction of movement of the car and arranging for this hook to cooperate with retaining hook or the like situated in the station at a location where it is required to open the door.

The invention will be better understood and otehr advantages of the invention will emerge more clearly from the following description given by way of example only and with reference to the appended non-limiting drawings.

DESCRIPTION OF THE PREFERRED EMBODIMENT

Figure 1:
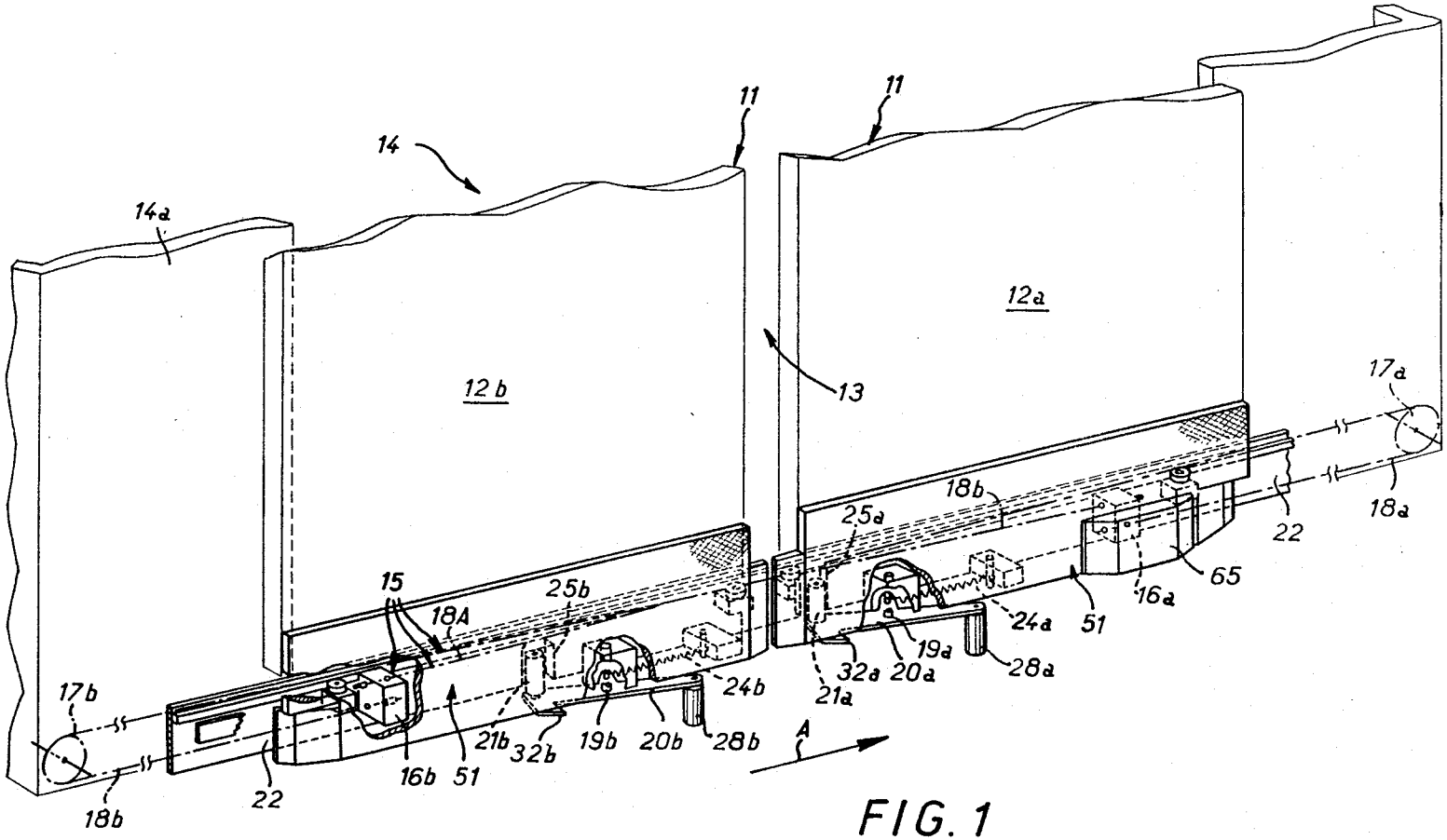
FIG. 1 is a general view of the lower part of a car of the system equipped with structural elements in accordance with the invention.

Referring to the drawings, there is shown the lower part of a lateral door 11 with two panels 12a and 12b closing off the door opening 13 in a car 14 of which only the platform-side lateral wall 14a is schematically represented in FIG. 1. In its essentials the car may be as described in the aforementioned U.S. Pat. No. 4,512,259. With reference to the direction of movement of the car as shown by the arrow A in FIG. 1, the panel 12a will be called the first panel whereas the panel 12b will be called the second panel. The means of operating the door 11 are arranged longitudinally in the lower part of the car in so far as the components carried by the car are concerned. The panels are obliged to move by translation in their own and common plane along the wall 14a by conventional guide means that will not be described in detail. The panels 12a and 12b are movable in opposite directions and coupled to each other by an arrangement of cables or chains 15 whereby they are constrained to move symmetrically relative to the center of the opening 13 and at the same speed, even if a force is applied to only one panel. To this end the arrangement 15 comprises, for each panel 12a or 12b, an anchor structure 16a or 16b in the form of a block fastened to the panel and a pulley wheel 17a or 17b disposed to rotate freely along the wall 14a at a sufficient distance from the corresponding panel to enable the opening 13 to be completely uncovered. Also, two cables 18a, 18b are connected between the anchor structures of the two panels. The cable 18a is connected at one end to the anchor structure 16a, is wound around the pulley wheel 17a and is connected at its other end to the anchor structure 16b. Similarly, the cable 18b is connected at one end to the anchor structure 16b, is wound around the pulley wheel 17b and is connected at its other end to the anchor structure 16a. It is to be understood that if chains were used instead of cables the pulley wheels 17 would be replaced by appropriate sprocket wheels. It emerges clearly from the description of the linking arrangement 15 that opening or closing one of the panels 12a or 12b results in an opening or closing movement of the same amplitude of the other panel. Thus in exploiting the slow movement of the car along a platform to open or close the door 11, use may be made of the first panel 12a to close the door and of the second panel 12b to open the door, as will be explained later.

According to an important feature of the invention the door 11 or at least one of its panels (12a) is fitted with a lever 20 mounted so as to pivot about a vertical axis 19 and provided with a rear abutment member 21, in this instance in the form of a roller held in contact with a surface 22 of the car 14, here forming a rolling track defined in the vicinity of the edge of the floor of the car. The lever 20 is spring-loaded by a spring 24 in turn attached to the door or to the panel in a direction adapted to hold the rear abutment member 21 in contact with the surface 22. The surface 22 comprises at least one housing 25 adapted to receive a corresponding rear abutment member 21 when the door is closed (as shown in FIG. 11). In the example described, each panel is equipped with a lever 20 and the relevant parts (springs 24, axes 19, housings 25, etc.) bear the same reference numbers for each panel, with the suffix a or b according to whether it is part of the first panel or part of the second panel. In this way the door 11 is double-locked in the closed position since it is sufficient for one of the rear abutment members 21a or 21b to be inserted in its housing to immobilize both panels 12a and 12b by virtue of the linking arrangement 15 described hereinabove.

The system further comprises means for turning the lever or each lever against the action of the spring means (springs 24a or 24b) in the direction tending to disengage the corresponding abutment member when the car reaches a location at which it is required to unlock the door, together with means for securing the door (or the front panel 12a) when the car reaches a location at which it is required to close the door.

Figure 4:
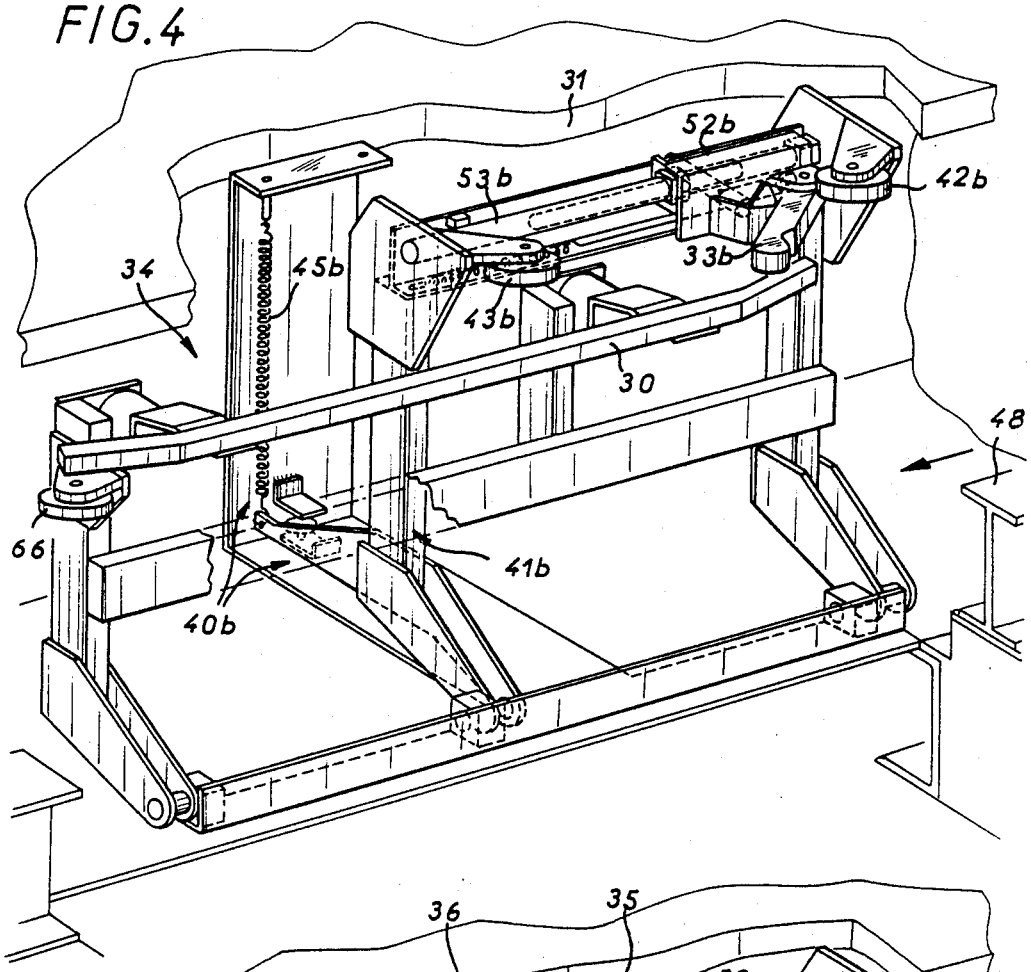
FIG. 4 is a perspective view of a mechanism for opening the door of the car from FIG. 1 disposed under the lip of a disembarkation platform.

In the examples of FIGS. 1 through 4, the means for turning the levers 20a and 20b comprise front abutment members 28a, 28b fastened to the levers 20a and 20b respectively and a longitudinal member forming a cam 30, visible in FIG. 4, placed beneath the lip of a platform 31 and facing the path of the car in such a way that the front abutment members come into contact with the longitudinal member, turning the levers at least during part of the movement of the car, as needed to initialize the door opening movement bringing the rear abutment member 21 into rolling contact with the surface 22. The longitudinal member 30 is part of a pivoting opening mechanism 34 that will be described later.

The previously mentioned means for securing the door when closed (in this instance, specifically to secure the panel 12a) comprise a first operating hook 32a fastened to the lever 20a and a first retaining hook 33a disposed below the lip of a platform 35 at a location where it is desired to close the door (see FIG. 2). The first retaining hook 33a forms part of a pivoting closing mechanism 36 that will be described later.

The operating hook 32a is merely cut out from the metal plate constituting the lever 20a. It projects laterally relative to the bottom edge of the door 11 when the abutment member 21a is in contact with the surface 22, that is to say when it is outside the housing 25a. On the other hand, when the abutment member 21a is in this housing the hook 32a is virtually retracted under the panel 12a and can no longer serve for execution of any operation.

Everything that has just been stated with regard to the first operating hook 32a fastened to the lever 20a and usable to close the door applies also to a second operating hook 32b fastened to the lever 20b and usable to open the door in cooperation with a second retaining hook 33b forming part of the pivoting opening mechanism 34. When the door is open the two hooks project relative to their respective panels because the rear abutment members 21a, 21b are outside their respective housings. The first operating hook 32a is therefore positioned to cooperate with the retaining hook 33a carried by the pivoting closing mechanism 36. Thus a mechanism of this kind is installed at any location where it is required to close the door. There will therefore be at least one of them on each disembarkation platform, at its departure end. One may also be placed as a safety measure at the end of the disembarkation platform, especially if the station comprises two platforms, one for embarkation and the other for disembarkation, which are not aligned with one another and if the cars are taken up by a special handling system ("turnaround" apparatus as described, for example, in U.S. Pat. No. 4,413,568) to move them from one platform to the other. In like manner, a pivoting opening mechanism 34 will be installed at any location where it is required to open the door. Thus there will be at least one of them on each disembarkation platform near the end thereof at which the cars arrive, and possibly another at the beginning of each embarkation platform.

The mechanism 36 comprises a fixed support 40*a* to the front of which is hinged a pivoting support 41*a* carrying the hook 33*a* and two reference rollers 42*a*, 43*a* mounted to rotate freely. The end of the hook 33*a* is slightly set back relative to the edge of the rollers 42*a*, 43*a* intended to come into contact with the car. The spring 45*a* is mounted vertically between the end of a lever 46*a* fastened to the pivoting support 41*a* and a vertical extension of the fixed support 40*a*. This spring therefore urges the pivoting support 41*a* elastically so that it swings towards the place where the car passes, that is to say towards the track 48. The minimum tilt position of the pivoting support is stabilized by a system of abutment members 50*a*. The rollers 42*a* and 43*a* are positioned so as to come into rolling contact with a lateral track 51 on the car, in this instance the outside surface of the door 11, in the lower part thereof. When these rollers are in contact with the bottom of the door (the pivoting support 41a being slightly pushed back against the action of the spring 45*a*) the retaining hook 33*a* is at a specific distance from the car, in a position such that it can encounter and retain the first operating hook 32*a* as this is the first hook to be offered up to it as a car passes with the door open. From this time the actual movement of the car causes closing of the door until the abutment member 21*a* engages in its housing 25*a*, simultaneously locking the door and separating the hooks 32*a* and 33*a*. The door is then closed and double-locked because the panel 12*b* has also moved until the abutment member 21*b* is inserted in its housing 25*b*.

Figure 2:
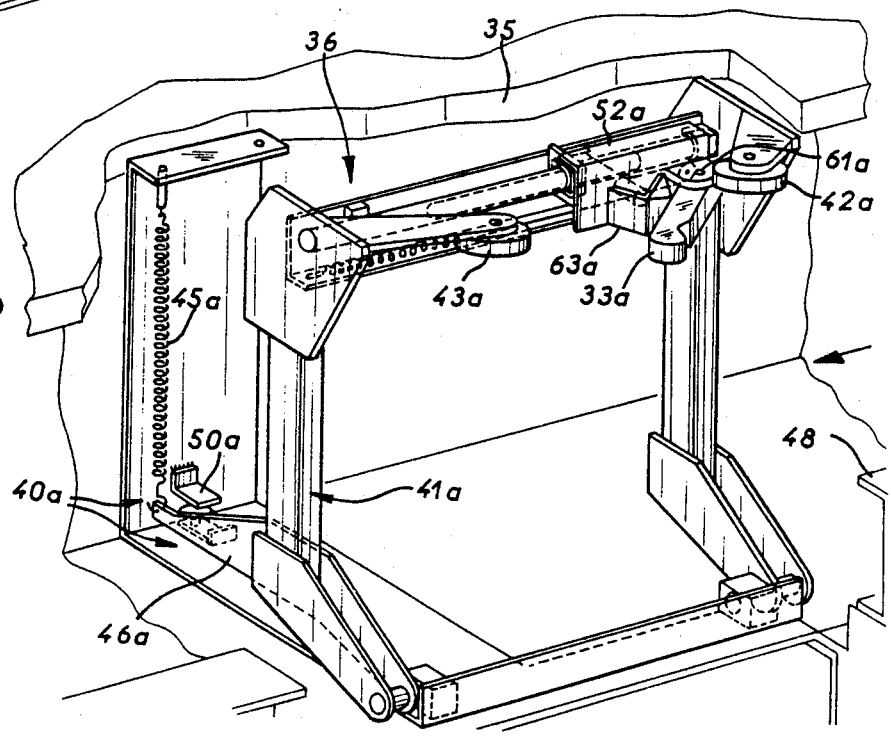
FIG. 2 is a perspective view of a mechanism for closing the door of the car from FIG. 1, disposed below the lip of an embarkation platform.
Figure 3:
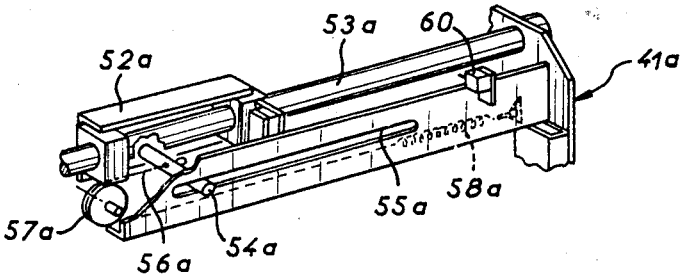
FIG. 3 is a partial rear view of the mechanism from FIG. 2.

With more particular reference to FIGS. 2 and 3, it is seen that the retaining hook 33*a* is mounted on a mobile assembly 52*a* adapted to move along a rod 53*a* of the pivoting support 41*a* parallel to the movement of the car. The mobile assembly 52*a* is prevented from rotating relative to the rod 53*a* and to this end comprises a transverse rod 54*a* engaged in an opening 55*a* in the pivoting support. This transverse rod also serves as an anchor point for a cable 56*a* which winds around a pulley wheel 57*a* and is connected to a spring 58*a* fixed at its other end to the pivoting support 41*a*. This arrangement urges the mobile assembly 52*a* into an abutment position at one end of the rod 53*a*. The force exerted by the spring 58*a* is normally sufficient to hold the mobile assembly in or substantially in this abutment position (see FIG. 2) when the retaining hook 33*a* cooperates with the operating hook 32*a* under normal operating conditions, that is to say providing that nobody is attempting to prevent the door closing. In the contrary case the mobile assembly, entraining the retaining hook with it, moves along the rod 53*a* along which are disposed means for triggering an audible alarm (not shown) and/or emergency breaking control means, for example a switch 60 (see FIG. 3) placed on the path of the mobile assembly 52*a* so as to be operated by it. The hook 33*a* is hinged by a vertical spindle 61*a* to the mobile assembly 52*a* and a retractable abutment member 63*a* is disposed between the mobile assembly and the hook 33*a*. This safety arrangement makes it possible to disengage the two hook 32*a* and 33*a* under all circumstances, by deformation of the block 63*a*, when the mobile assembly 52*a* has completed its full travel. This ensures that neither hook can ever be damaged or torn away by the other. Sensing means (not shown) such as a switch is fixed to the support 41a downstream of the hook 33*a* so as to command shutting down of the system if a hook 32*a* or 32*b* that is not locked has caused tilting of the hook 33*a*.

The pivoting opening mechanism 34 is closely similar to the closing mechanism 36 and analogous structural components, which carry the same reference numbers but with the suffix b rather than a, will not be described in detail a second time.

A fixed support 40*b* has hinged to it a pivoting support 41*b* urged towards the car by a spring 45*b*. The pivoting support 41*b* is longer than the support 41*a* because it carries the previously mentioned longitudinal member forming the cam 30. This latter therefore benefits from the reference positioning achieved by the rollers 42*b* and 43*b*. The mounting of the retaining hook 33*b* on the mobile assembly 52*b* is precisely the same as the mounting of the hook 33*a*. However, the reference roller 43*b* is positioned so that it can come into contact with a cam 65 (FIG. 1) located on an increased thickness part of the lateral track 51 on which the reference rollers roll when the hook 32*a* reaches the vicinity of the hook 33*b*, the door being closed but unlocked as a result of the action of the longitudinal member 30. The passage of the roller 43*b* over this cam causes the pivoting support 41*b* to tilt slightly backwards and prevents engagement of the hooks 32*a* and 33*b* which would merely confirm the closing of the door. When the hook 32*b* reaches the vicinity of the hook 33*b* the cam 65 has already passed over the roller 43*b* and the coming together of the two hooks opens the door. On completion of such opening a supplementary roller 66 carried by the pivoting support 41*b* comes into contact with another structural component (not shown) serving as a cam fastened to the car and again causes slight backwards tilting of the pivoting support 41*b*, separating the hooks 32*b* and 33*b*.

It is to be understood that the backward tilting function as implemented by the reference roller 43*b* could be achieved by another roller placed at another location, for example the roller 66 cooperating with another cam.

The functioning of the system that has just been described with reference to FIGS. 1 through 4 is evident from the foregoing description.

When a car the door 11 of which is open reaches a closing mechanism 36 the two hooks 32*a* and 32*b* project towards the outside because the door is open. Consequently, the retaining hook 33*a* comes into contact with the first operating hook in the direction in which the car is moving, that is to say the hook 32*a*. The two panels 12*a* and 12*b* of the door are closed since the panel 12*a* is temporarily immobilized relative to the platform as the car continues to move forward. When the two panels meet up, the two abutment members 21*a* and 21*b* are simultaneously inserted into their respective housings 25*a* and 25*b*, which simultaneously releases the hook 32*a* and double-locks the door 11. The car then continues on its way until it reaches, for example, a disembarkation platform at which there is a pivoting opening mechanism 34. At this state the longitudinal member 30 actuates the front abutment members 28*a* and 28*b* of the respective levers 20*a* and 20*b*, the consequence of which is to unlock the door 11. Then as already explained, the hook 32*a* is released from the retaining hook 33*b* by the cam 65 so that it is the hook 32*b* which is retained which opens the door 11. The end of the opening phase corresponds to the moment at which the roller 66 comes into contact with another actuator cam carried by the car which causes backward tilting of the pivoting support 41*b* and consequently release of the hook 32*b*. From this moment the door 11 remains open until the car again passes a closing mechanism 36.

Figure 5:
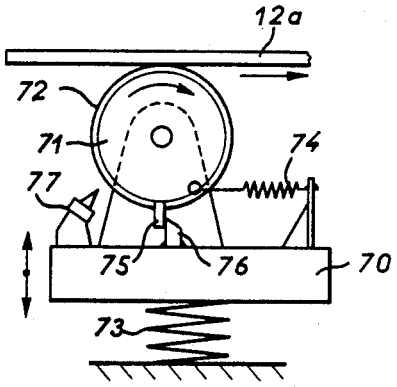
FIG. 5 is a schematic showing an arrangment for closing a door of a car in accordance with FIG. 1, in one possible embodiment of the invention.

FIG. 5 shows alternate means for securing the door 11 or its first panel 12*a*. A support 70 (pivoting or otherwise) fastened to the platform and movable in the direction towards the door or the panel 12*a* carries friction engagement means, for example a roller 71 with a elastomer material contact facing 72, whilst spring means symbolically represented here by a spring 73 urge this roller against the outside surface of the door or the panel 12*a*. The roller is "flexibly" prevented from rotating by a spring 74 connected between a point on its periphery and the support 70.

Under normal operating conditions a peg 75 fastened to the roller is held against an abutment 76 fastened to the support 70 by the action of the springs 74. If an excessively high reaction force is exerted by the panel 12*a*, the peg 75 can operate alarm and/or emergency stop control means 77 (here symbolically represented by a switch) placed on the path of movement of the peg. An analogous system may be used to open a two-panel door, provided that its movement is synchronized with the passage of the second panel.

Figure 6:
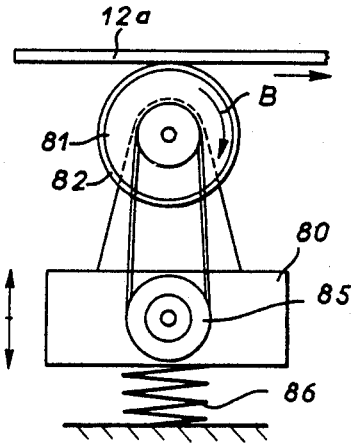
FIG. 6 shows an arrangment for opening a door of a car in accordance with FIG. 1, in one possible embodiment of the invention.

FIG. 6 shows alternative means for opening the door 11 by positively entraining the door or its first panel 12*a*. A support 80 (pivoting or otherwise) fixed to the platform and movable in the direction towards the door or the panel 12*a* carries a friction engagement roller 81 fitted with a contact facing 82 of elastomer material, for example. The roller 81 is rotated in the direction of movement of the car, that is to say in the direction of the arrow B, and at a speed such that the tangential speed at the surface of the facing is greater than the speed at which the car moves past the roller 81. The roller 81 is rotated by a motor 85. The roller and the motor are mounted on the support 80 and this is urged elastically towards the outside surface of the door or the panel 12*a* by a spring 86 or analogous means.

The invention may be implemented differently from the embodiments that have just been described.

The locking of the door may be achieved by a lever carried by the car and engaging in a housing in the door. In the case of a door with two interconnected panels, locking may be achieved between the two panels.

More generally, this invention, which is particularly adapted to cars moving slowly during the embarkation and disembarkation of passengers, may equally well be addressed to cars stopping to dissembark passengers and then moving off while the door is closed.

There is claimed:

1. Transportation system employing at least one car provided with at least one sliding door, comprising means for locking said at least one door in a closed position, means for unlocking said at least one door adapted to be operated as said car passes a predetermined location, wherein said locking means comprise a lever pivoted to said at least one door, a rear abutment member on said lever adapted to come into contact with a surface of said car, spring means urging said lever into contact with said surface via said rear abutment member, and a housing in said surface adapted to receive said rear abutment member when said at least one door is closed, and wherein said unlocking means comprise means for turning said lever against the action of said spring means in the direction tending to disengage said rear abutment member from said housing when said car reaches a location at which said at least one door is required to be unlocked, and means for securing said at least one door until said locking means are operated when said car reaches a location at which said at least one door is required to be closed.

2. Transportation system according to claim 1, wherein said door securing means comprise a mobile part adapted to be moved by a reaction force exerted on it by said at least one door, means for immobilizing said mobile part by opposing said reaction force under normal operating conditions and emergency stop and/or alarm triggering means adapted to be operated by said mobile part when it has moved a predetermined amount against the action of said immobilization means.

3. Transportation system according to claim 1, wherein said lever turning means comprise a longitudinal member serving as a cam disposed facing the path of said car and said lever carries a front abutment member adapted to cooperate with said cam.

4. Transportation system according to claim 1, wherein said door retaining means comprise a first operating hook fastened to said lever and adapted to project laterally when said rear abutment member is in contact with said surface, in which position it is adapted to cooperate with retaining means disposed at a location where said at least one door is required to be closed, and to occupy a retracted position when said rear abutment member is in said housing.

5. Transportation system according to claim 4, further comprising a pivoting closing mechanism adapted to be located at an embarkation point, a retaining hook on said pivoting closing mechanism, spring means adapted to urge said pivoting closing mechanism towards the path of said car, and a reference roller on said pivoting closing mechanism adapted to contact a track on the side of said car when moving past said embarkation point so as to hold said retaining hook at a predetermined distance from said car so that it is enabled to come into contact with and retain said operating hook.

6. Transportation system according to claim 1, wherein said at least one door comprises two panels adapted to move in respective opposite directions and means linking said panels together so that they move symmetrically relative to a door opening in said car.

7. Transportation system according to claim 6, wherein said locking means comprise a lever pivoted to said at least one door, a rear abutment member on said lever adapted to come into contact with a surface of said car, spring means urging said lever into contact with said surface via said rear abutment member, and a housing in said surface adapted to receive said rear abutment member when said at least one door is closed, and wherein said unlocking means comprise means for turning said lever against the action of said spring means in the direction tending to disengage said rear abutment member from said housing when said car reaches a location at which said at least one door is required to be unlocked, further comprising a respective lever pivoted to each panel, a respective operating hook on each of said levers and a respective rear abutment member on each of said levers adapted to come into contact with a surface of said car in such a way that the respective operating hook projects laterally, respective spring means operative on each of said levers and adapted to urge it in a direction to bring said rear abutment member into contact with said surface of said car, respective housings in said surface of said car adapted to receive said rear abutment members on said levers when said panels are in the door closed position so as to retract said hooks and double-lock said door, means for pivoting said levers against the action of said spring means in a direction to cause said hooks to emerge and release said rear abutment members from said housings, said pivoting means being responsive to said car reaching a location where it is required to unlock said door, a first retaining hook disposed at an embarkation point and adapted to cooperate selectively with said first operating hook according to the direction of movement of said car in order to close said door, and a second retaining hook disposed at a disembarkation point and adapted to cooperate selectively with said second operating lock according to the direction of movement of said car in order to open said door.

8. Transportation system according to claim 7, comprising a pivoting closing mechanism carrying said first retaining hook and a pivoting opening mechanism carrying said second retaining hook, said closing and opening mechanisms being respectively disposed at an embarkation point and a disembarkation point, respective spring means urging said mechanisms towards the path of said car, and a respective reference roller on each mechanism adapted to come into contact with a track on the side of said car when moving past the respective embarkation or disembarkation point to hold the respective retaining hook at a predetermined distance from said car in a position such that it is enabled to come into contact with said first or second operating hook.

9. Transportation system according to claim 8, comprising a cam on said car, a roller on said pivoting opening mechanism adapted to come into contact with said cam so that said mechanism is temporarily pushed back when said first operating hook passes said second retaining hook.

10. Transportation system according to claim 9, wherein said roller is said reference roller on said mechanism and said cam is attached to said track on the side of said car.

11. A transportation system including at least one car movable under a path of movement, said car having at least one sliding door slideable between open and closed positions and a door operating system comprising means for opening the door and means for closing the door, said means for closing the door comprising door retaining means disposed at a location along the path of movement of the car where the door is to be closed, said door retaining means being cooperable with first means on said door for opposing movement of the door relative to said location until the door reaches the closed position, and means for selectively locking and unlocking the door when the door is in said closed position.

12. A door operating system according to claim 11, wherein said door retaining means comprises a mobile part movable in response to a reaction force exerted by said door, means for normally holding said mobile part against movement, emergency stop and/or alarm triggering means adapted to be operated by said mobile part in response to a predetermined displacement thereof against the action of said means for normally holding said mobile part against movement.

13. A door operating system according to claim 11, wherein said door retaining means comprises a friction engagement member and means for urging said friction engagement member against an outside surface of said door.

14. A door operating system according to claim 11, wherein said means for opening said door comprises an engagement roller adapted to be rotated at a speed such that the tangential speed of its surface is greater than the speed of said car as it passes said roller and spring means for urging said roller towards an outside surface of said door.

15. A door operating system according to claim 11, wherein said at least one door comprises two panels adapted to move in respective opposite directions and means linking said panels together so that they move symmetrically relative to a door opening in said car.

16. A door operating system according to claim 15, wherein said linking means comprise a respective anchor structure fastened to each of said panels, direction-changing means on said car at a distance from said door opening, and two linking members each having one end attached to the anchor structure on one of said panels, extending around the respective direction-changing means and having its other end attached to the anchor structure on the other of said panels.

17. A door operating system according to claim 11, wherein said means for selectively locking and unlocking comprises a lever pivoted to said door, a rear abutment on said lever adapted to come into contact with a surface of said car, spring means coacting with said lever for urging said rear abutment into contact with said car surface, a recess in said surface for receiving said rear abutment when said door is in said closed position, and releasing means cooperable with said lever for turning said lever against the action of said spring means in a direction tending to disengage said rear abutment from said recess.

18. A door operating system according to claim 17, wherein said releasing means comprises a longitudinal member defining a cam, said lever having a front abutment member cooperable with said cam.

19. A door operating system according to claim 17, wherein said first means cooperable with said door retaining means comprises a first operating hook fastened to said lever adapted to project laterally when said rear abutment member is in contact with said surface and adapted to occupy a retracted position when said rear abutment member is received in said recess.

20. A door operating system according to claim 19, wherein said first operating hook is mounted on a pivoting closing mechanism, the first mentioned location being at an embarkation point, spring means urging said pivoting closing mechanism towards said car at said embarkation point, and a reference roller on said pivoting closing mechanism cooperable with a track on a side of said car when it moves past said embarkation point so as to position said retaining hook at a predetermined distance from said car so as to contact and retain said operating hook.

21. A door operating system according to claim 20, wherein said pivoting closing mechanism is disposed beneath the lip of an embarkation platform.

22. A door operating system according to claim 19, wherein said door comprises first and second panels movable in respective opposite directions for opening and closing a door opening in said car and means linking said first and second panels together for movement symmetrically relative to said door opening in said car, the first mentioned lever being provided on said first panel and a second said lever being provided on said second panel, said location where said door is to be closed being an embarkation point, said door retaining means comprising a first retaining hook selectively cooperable with said first operating hook on said first lever depending on the direction of movement of said car, and a second retaining hook being provided at a disembarkation point selectively cooperable with a second operating hook on said second lever depending on the direction of movement of said car.

23. A door operating system according to claim 22, wherein said first retaining hook is carried on a pivoting closing mechanism and said second retaining hook is carried on a pivoting opening mechanism, respective spring means urging said closing and opening mechanisms toward said car at the respective embarkation or disembarkation point, a reference roller provided on each of said mechanisms cooperable with a track on the side of said car when it moves past the respective embarkation or disembarkation point for holding the respective first or second retaining hook at a predetermined distance from said car to enable contact with the respective first or second operating hook.

24. A door opening system according to claim 41, wherein each of said levers has a front abutment member, said releasing means comprising means for pivoting each of first and second levers to free their rear abutment members from respective housings including a longitudinal cam attached to said pivoting opening mechanism and cooperable with said front abutment members.

25. A door operating system according to claim 23, wherein said pivoting opening and closing mechanisms are disposed beneath the lip of respective disembarkation and embarkation platforms.

26. A door operating system according to claim 23, further comprising a cam on said car, roller means on said pivoting opening mechanism cooperable with said cam for pushing back said first operating hook to enable said first operating hook to freely move past said second retaining hook.

27. A door operating system according to claim 26, wherein said roller means on said pivoting opening mechanism is defined by said reference roller, and said cam is attached to said track on the side of said car.

28. A door opening system according to claim 23, further comprising a respective mobile assembly carrying each of said retaining hooks and movable in a direction substantially parallel to the path of movement of the car, a spring urging each of said assemblies in a predetermined position in which the respective retaining hook cooperates with the corresponding operating hook under normal operating conditions.

29. A door operating system according to claim 28, further comprising alarm and/or emergency braking control means responsive to movement of the respective mobile assemblies against the action of the respective spring.

30. A door operating system according to claim 28, wherein each of said retaining hooks is pivoted to a respective one of said mobile assemblies, and further comprising classically deformable abutment means disposed between each of said retaining hooks and the respective mobile assembly for permitting the retaining hook to be disengaged from the corresponding operating hook when the mobile assembly reaches a limit position remote from said predetermined position.

31. A door operating system according to claim 30, comprising sensing means fixed to said pivoting closing mechanism downstream of said first retaining hook for commanding disenablement of the transporting system in response to one of said operating hooks in its unlocked position causing one of said retaining hooks to pivot.

32. A transportation system including at least one car movable along a path of movement, said car having at least one door including first and second panels linked together for sliding displacement towards and away from each other between closed and open positions, and a door operating system comprising means for closing the door and means for opening the door, said means for closing the door comprising a door retaining means at a first location along the path of movement of the car where the door is to be closed, said first door retaining means being cooperable with first operating means on said first panel for opposing movement of said first panel relative to said first location until the panels of the door reach the closed position, said means for opening the door comprising second retaining means at a second location along the path of movement where the door is to be open, said second retaining means being cooperable with second operating means on said second panel for opposing movement of said second panel relative to said second location until said panels of the door reach the open position, and means for selectively locking and unlocking the panels when said panels are in the closed position.

* * * * *